US006557540B1

(12) United States Patent
Mianzo et al.

(10) Patent No.: US 6,557,540 B1
(45) Date of Patent: May 6, 2003

(54) METHOD OF CALCULATING A VALVE TIMING COMMAND FOR AN ENGINE

(75) Inventors: Lawrence A. Mianzo, Plymouth, MI (US); Brett D. Collins, Ypsilanti, MI (US); Ibrahim Haskara, Brownstown, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/014,286

(22) Filed: Dec. 11, 2001

(51) Int. Cl.[7] ..... F01L 1/34
(52) U.S. Cl. ..... 123/678; 123/90.15; 701/103
(58) Field of Search ..... 123/678, 90.15, 123/90.19; 701/103

(56) References Cited

U.S. PATENT DOCUMENTS

| | | | | | |
|---|---|---|---|---|---|
| 4,700,684 | A | | 10/1987 | Pischinger et al. | |
| 5,743,221 | A | | 4/1998 | Schmitz | |
| 5,752,491 | A | | 5/1998 | Schmitz et al. | |
| 6,053,137 | A | * | 4/2000 | Trzmiel et al. | 123/90.17 |
| 6,196,174 | B1 | * | 3/2001 | Wada et al. | 123/90.15 |
| 6,330,869 | B1 | * | 12/2001 | Yoshiki et al. | 123/90.15 |
| 2001/0004884 | A1 | * | 6/2001 | Tachibana et al. | 123/90.15 |
| 2001/0013324 | A1 | * | 8/2001 | Yoshizawa et al. | 123/90.16 |
| 2002/0092488 | A1 | * | 7/2002 | Aoyama et al. | 123/90.16 |

* cited by examiner

*Primary Examiner*—Erick Solis
(74) *Attorney, Agent, or Firm*—Brinks Hofer Gilson & Lione

(57) ABSTRACT

A method to calculate valve timing commands for an engine with variable valve timing is hereby disclosed. The method includes determining a valve feedforward term based on an engine performance command and an environmental conditions signal, calculating a valve feedback term based on the engine performance command and an engine performance feedback, and calculating a valve timing command based on the valve feedforward term and the valve feedback term.

16 Claims, 3 Drawing Sheets

METHOD OF CALCULATING A VALVE TIMING COMMAND FOR AN ENGINE

TECHNICAL FIELD

This invention relates generally to calculating commands for an engine and, more specifically, to calculating a valve timing command for an engine with variable timing valve actuators.

BACKGROUND

In gasoline engines of most vehicles, each cylinder of the engine cycles through four unique stages. In the first stage, an inlet valve opens and a piston draws air and fuel through the inlet valve and into the cylinder. The inlet valve closes and the piston reverses direction in the second stage to compress the air and fuel mixture. In the third stage, a spark combusts the mixture, which drives the piston (and powers the vehicle). An exhaust valve opens and the piston once again reverses direction, in the fourth stage, to push the combusted mixture through the exhaust valve and out of the cylinder.

The controlling of the inlet valve and the exhaust valve of each cylinder is a difficult task. The engine speed, which can exceed 6,000 rpm in most vehicles, dictates that the opening and closing of the inlet valve and the exhaust valve must be able to occur up to 50 times per second. In conventional engines, cams driven by the engine actuate the inlet valve and the exhaust valve. Modern research, however, has shown that fuel efficiency and power output of the engine may be optimized with an adjustment of the valve timing for a particular load on the engine. Some variable valve timing engines have been proposed, but the theoretical fuel efficiency and output power of these engines have not yet been reached.

DESCRIPTION OF THE PREFERRED METHODS

The following description of the two preferred method of the invention is not intended to limit the invention to these preferred methods, but rather to enable any person skilled in the art of variable valve timing control to make and use this invention.

Figure 1:
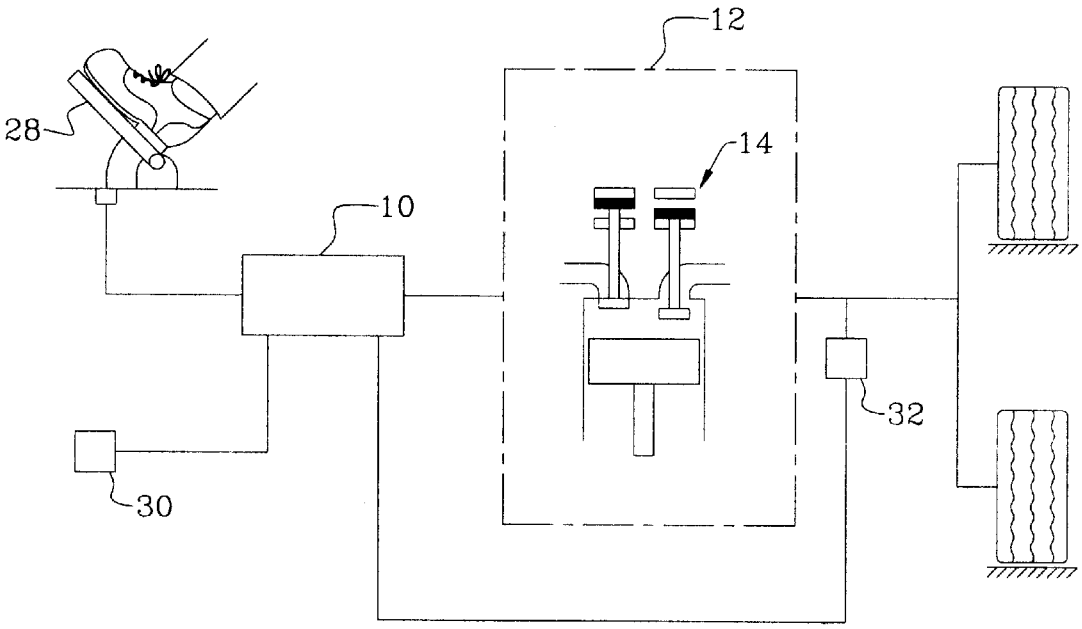
FIG. 1 is schematic of a vehicle having an engine controlled with the method of the preferred embodiment.

As shown in FIG. 1, the preferred method of the invention has been specifically created to be performed by a control unit 10 to calculate valve timing commands for an engine 12 with electromagnetic valve actuators 14. The method, however, may be performed by any suitable device to calculate valve timing commands for any suitable engine with any suitable variable timing valves.

Figure 2:
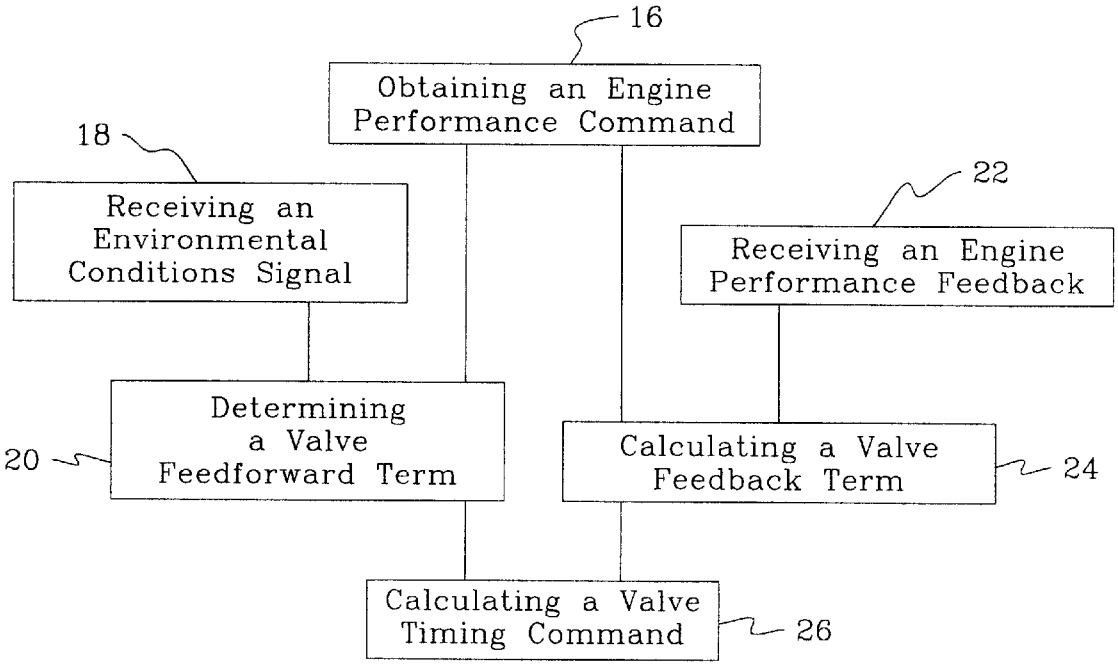
FIG. 2 is a flowchart of the method of the preferred embodiment.

As shown in FIG. 2, the preferred method of the invention has six principle actions: obtaining an engine performance command 16; receiving an environmental conditions signal 18; determining a valve feedforward term 20; receiving an engine performance feedback 22; calculating a valve feedback term 24; and calculating a valve timing command 26 based on the valve feedforward term and the valve feedback term. The method performed by the control unit may, of course, include other suitable actions before, during, or after these principle actions.

The action of obtaining an engine performance command 16 preferably includes receiving a vehicle performance command from a driver. Preferably, the vehicle performance command is received from the foot of a driver with the use of a conventional pedal 28, as shown in FIG. 1. Alternatively, the vehicle performance command could be received from the driver with the use of any suitable device. The action of obtaining an engine performance command also preferably includes deriving the engine performance command from the vehicle performance command. The engine performance command is preferably based on the vehicle performance command, but may alternatively be based on additional suitable factors, such as a traction control signal or a cruise control signal. The engine performance command is preferably a desired engine torque and, for this reason, the engine performance command may be thought of as an engine torque command. The engine performance command, however, may alternatively be another suitable variable, such as a desired engine acceleration.

The action of receiving an environmental conditions signal 18 preferably includes receiving an environmental conditions signal from an environmental sensor 30 in the vehicle. The environmental sensor 30 preferably senses the ambient temperature outside the vehicle and communicates this data to the control unit 10, which uses the data to determine the valve feedforward term. Other information, such as the ambient pressure, may be useful in the determination of the valve feedforward term. For this reason, the environmental sensor 30 may alternatively sense other suitable information. The environmental sensor 30 is preferably a conventional environmental sensor, but may alternatively be any suitable device.

Similarly, the action of receiving an engine performance feedback 22 preferably includes receiving the engine performance feedback from an engine sensor 32 in the vehicle. The engine sensor 32 preferably senses the engine speed and communicates this data to the control unit 10, which uses the data to determine the valve feedforward term and the valve feedback term. Other engine measurables, such as engine torque data, may be useful in the determination of the terms. For this reason, the engine sensor 32 may alternatively sense other suitable information. The engine sensor 32 is preferably a conventional engine sensor, but may alternatively be any suitable sensor.

The action of determining a valve feedforward term 20 preferably includes determining the valve feedforward term based on the engine torque command, the ambient temperature data, and the engine speed data. The determination, however, may be based on other suitable factors, such as engine torque data, air-fuel ratio data, engine combustion stability data, or ambient pressure data. The control unit 10 preferably includes a look-up table, which has been optimized for fuel efficiency, power output, and engine emissions based on various engine torque commands, various ambient temperature data, and various engine speed data (or engine torque data). The control unit 10 may alternatively be programmed to perform a real-time optimization of the fuel efficiency, power output, and engine emission (or any other suitable measurement) based on the engine torque command, the ambient temperature data, and the engine speed data (or any other suitable commands and measurables).

The action of calculating the valve feedback term 24 preferably includes comparing the engine performance command and the engine performance feedback. By the definition of the term, the valve feedback term functions to compare the input with the output and to calculate a correction term based on the difference, if any. The comparison and the calculation are preferably accomplished by the control unit 10, but may alternatively be accomplished by a suitable separate device.

Figure 3A:
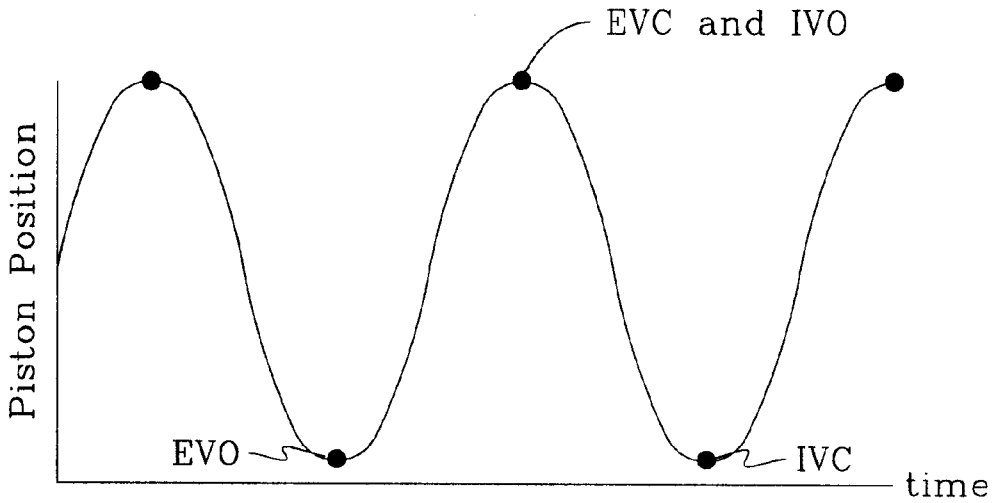
FIG. 3 is two timing charts of the valves of an engine.
Figure 3B:
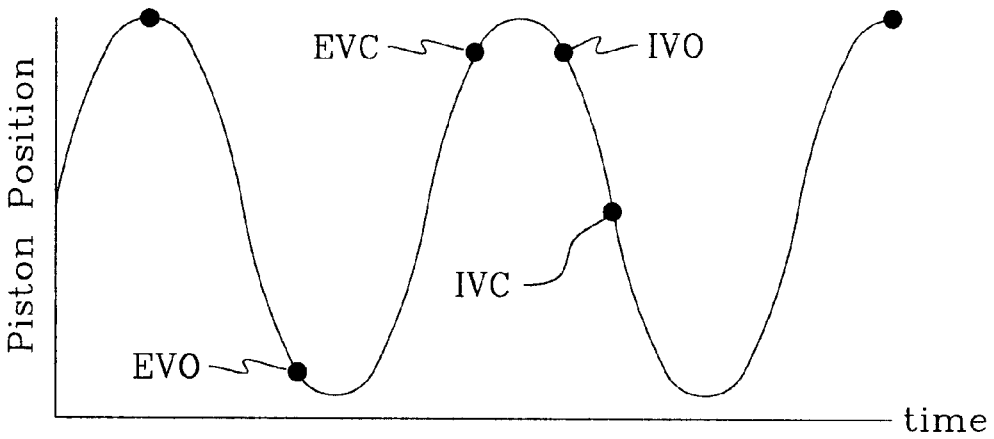

As shown in FIG. 3A, the position of the piston in the cylinder can be traced as a sinusoidal wave over a time period. The events of the opening of the exhaust valve ("EVO"), the closing of the exhaust valve ("EVC"), the opening of the inlet valve ("IVO"), and the closing of the inlet valve ("IVC") can be placed on this sinusoidal wave. As shown in FIG. 3B, the events of the EVO, the EVC, the IVO, and the IVC may be shifted within the time period (note that the shift in the EVC and the IVO preferably mirror each another, but may alternatively be separately controlled). The adjustment of the timing of the EVO, the EVC/IVO, and the IVC when used partially, separately, or together may provide the desired fuel efficiency, power output, and emissions from the engine 12 of the vehicle. The action of calculating a valve timing command 26 preferably includes calculating an EVO command, an EVC/IVO command, and an IVC command. The control unit 10, of course, may alternatively include other suitable parameters for the control of the variable timing valves.

The second preferred method of the invention includes the principle actions of the first preferred method and the additional principle action of receiving fuel conversion data and engine emissions data. These preferably include receiving the fuel conversion data and engine emissions data from suitable emission sensors (not shown) in the cylinder or the exhaust port of the engine 12. The emission sensors preferably sense the amount of $NO_x$ in the exhaust and communicates this data to the control unit 10. The control unit 10 preferably uses this information to modify the output value from the look-up table, but may alternatively use this information to continually adjust the values in the look-up table. The control unit 10 may alternatively use this information as another factor in the determination of the valve feedback term. The emission sensors are preferably conventional emission sensors, but may alternatively be any suitable sensor.

As any person skilled in the art of variable valve engine control will recognize from the previous detailed description and from the figures and claims, modifications and changes can be made to the preferred methods without departing from the scope of this invention defined in the following claims.

We claim:

1. A method for calculating a valve timing command for an engine of a vehicle, comprising:

obtaining an engine performance command;

receiving an environmental conditions signal;

determining a valve feedforward term based on the engine performance command and the environmental conditions signal;

receiving an engine performance feedback;

calculating a valve feedback term based on the engine performance command and the engine performance feedback; and calculating a valve timing command based on the valve feedforward term and the valve feedback term.

2. The method of claim 1 wherein said obtaining an engine performance command includes receiving a vehicle performance command from a driver of the vehicle and deriving the engine performance command based on the vehicle performance command.

3. The method of claim 1 wherein said receiving an environmental conditions signal includes receiving ambient temperature data.

4. The method of claim 3 wherein said determining a valve feedforward term includes determining the valve feedforward term based on the ambient temperature data.

5. The method of claim 4 wherein said determining a valve feedforward term includes determining the valve feedforward term based on the engine performance feedback.

6. The method of claim 5 wherein said determining a valve feedforward term includes referencing a look-up table with the engine performance command, the ambient temperature, and the engine performance feedback.

7. The method of claim 1 wherein said receiving an engine performance feedback includes receiving engine speed data.

8. The method of claim 1 wherein said obtaining an engine performance command includes obtaining an engine torque command; and wherein receiving an engine performance feedback includes receiving engine torque data.

9. The method of claim 8 wherein calculating a valve feedback term includes calculating a valve feedback term based on the engine torque command and the engine torque data.

10. The method of claim 1 wherein said calculating a valve timing command includes calculating an EVO command, an EVC/IVO command, and an IVC command.

11. The method of claim 1 further comprising receiving fuel conversion data.

12. The method of claim 11 wherein said determining a valve feedforward term includes determining a valve feedforward term based on the fuel conversion data.

13. The method of claim 11 wherein said calculating a valve feedback term includes calculating a valve feedback term based on the fuel conversion data.

14. The method of claim 1 further comprising receiving engine emissions data.

15. The method of claim 14 wherein said determining a valve feedforward term includes determining a valve feedforward term based on the engine emissions data.

16. The method of claim 11 wherein said calculating a valve feedback term includes calculating a valve feedback term based on the engine emissions data.

* * * * *